US008047262B2

(12) United States Patent
Kweon

(10) Patent No.: US 8,047,262 B2
(45) Date of Patent: Nov. 1, 2011

(54) COOLING SYSTEM FOR LOW-PRESSURE CASTING MOLD

(75) Inventor: Kyung Sik Kweon, Ulsan (KR)

(73) Assignee: Hyundai Motor Company, Seoul (KR)

( * ) Notice: Subject to any disclaimer, the term of this patent is extended or adjusted under 35 U.S.C. 154(b) by 273 days.

(21) Appl. No.: 12/276,937

(22) Filed: Nov. 24, 2008

(65) Prior Publication Data

US 2009/0255643 A1 Oct. 15, 2009

(30) Foreign Application Priority Data

Apr. 10, 2008 (KR) ..... 10-2008-0033393

(51) Int. Cl.
*B22D 30/00* (2006.01)
*B22D 18/04* (2006.01)

(52) U.S. Cl. ..... 164/348; 164/284

(58) Field of Classification Search ..... 164/284, 164/306, 119, 348
See application file for complete search history.

(56) References Cited

U.S. PATENT DOCUMENTS 4,875,518 A * 10/1989 Imura et al. ..... 164/119

FOREIGN PATENT DOCUMENTS

| | | |
|---|---|---|
| JP | 2003-025045 | 1/2003 |
| KR | 10-1995-0031324 | 12/1995 |
| KR | 10-2002-0044028 A | 6/2002 |
| KR | 10-2005-0043014 | 5/2005 |
| KR | 10-2005-0098492 A | 10/2005 |

* cited by examiner

*Primary Examiner* — Kevin P Kerns
(74) *Attorney, Agent, or Firm* — Edwards Angell Palmer & Dodge LLP; Peter F. Corless

(57) ABSTRACT

A cooling system for a low-pressure casting mold is provided, in which a sprue is located at a side surface of a cylinder head to ensure a sufficient distance between a combustion chamber and the sprue so that a combustion chamber cooling system combined with water cooling and air cooling is provided in a lower mold, thus reducing cycle time. Moreover, the cooling system for a low-pressure casting mold improves mechanical properties of a material used by reducing dendrite arm spacing (DAS) and porosity.

7 Claims, 20 Drawing Sheets

COOLING SYSTEM FOR LOW-PRESSURE CASTING MOLD

CROSS-REFERENCE TO RELATED APPLICATION

This application claims under 35 U.S.C. §119(a) the benefit of Korean Patent Application No.10-2008-0033393 filed Apr. 10, 2008, the entire contents of which are incorporated herein by reference.

BACKGROUND (a) Technical Field

The present invention relates to a cooling system for a low-pressure casting mold. More particularly, the present invention relates to a cooling system for a low-pressure casting mold, which can reduce cycle time with an improved cooling rate and improve properties of a material used.

(b) Background Art

Generally, a low pressure casting process is intended to gradually cast molten metal at low pressure from a lower portion of a mold, and to allow the molten metal to be solidified. Such a low pressure casting process is used to produce engine blocks, cylinder heads, wheels, etc., since the molten metal produces few casting defects with fewer foreign substances, such as oxides, and thus it is possible to produce precision casting products.

The low pressure casting process is used in casting aluminum alloys, as well as copper alloys and cast iron. For an aluminum alloy, an appropriate mold temperature is 300 to 400° C. Since the bottom of the mold is adjacent to a heat source, its temperature is naturally about 50 to 100° C. higher, and thus it is possible to achieve directional solidification.

A low pressure casting process is determined by a correlation between a change in pressure of a pressure tank and a back pressure in the mold space. The higher the casting rate, the higher the back pressure; however, the back pressure is negligible compared with the pressure of a tank if the gas is sufficiently exhausted.

Accordingly, in the casting process, it is necessary only to control the pressure of the tank.

A pressurizing process in the low pressure casting process is divided broadly into three steps. The first step is a process in which molten metal rises directly under a sprue in a feeding pipe (connection pipe) upon pressurization.

In this case, the connection pipe is kept warm using a gas burner to reduce a drop in temperature of the molten metal. Moreover, since the molten metal should rapidly rise in a state where air is not mixed by shaking of the molten metal or oxides, it is necessary to use a casting machine with ventilation capability.

The second step is a process in which the molten metal is cast into the mold space through the sprue. The casting rate should be high to prevent occurrence of whirl and should be low to prevent gas inclusion.

The third step is a solidification process after the molten metal is completely cast into the mold and is related to a riser effect. According to this step, it is preferable that the pressurizing force is high; however, if it is too high, a gas discharge hole may become clogged or a coating material may be peeled off.

When a sand core is used, it is necessary to control the shift timing from the second step to the third step and the pressure rate.

Accordingly, after the molten metal cast into the mold is completely solidified, the molten metal in the feeding pipe that is not yet solidified is returned to a molten-metal holding furnace by eliminating the pressure exerted thereon, and the mold is opened to enable the molded product to be extracted.

FIG. 1 is a schematic diagram showing an exemplary conventional low-pressure casting apparatus for aluminum products, in which a mold is disposed at an upper portion and a casting means for casting molten metal is disposed at a lower portion.

The mold is divided into an upper mold 1 and a lower mold 2, in which the upper mold 1 is connected to a moving plate 3 moving up and down.

The casting means includes a tank 6 having a predetermined volume, in which a pressure gas supply inlet 4 is formed on one side and a molten metal filling inlet 5 is formed on the other side, a furnace 7 disposed on the bottom surface of the tank 6, and a casting passage 8, through which the molten metal in the furnace 7 is cast into a cavity of the mold, connected between the furnace 7 and the cavity of the mold.

Accordingly, at the same time when gas is supplied into the tank 6 through the pressure gas supply inlet 4, the pressure of the gas is exerted on the surface of the molten melt in the furnace 7 and, subsequently, the molten melt is cast into the cavity of the mold through the casting passage 8. After the molten melt cast into the mold is completely solidified, the pressure is removed to allow a molded product to be extracted.

FIGS. 2 and 9 are diagrams illustrating the position of a sprue 11 in a conventional low-pressure casting mold for a cylinder head 10, in which the sprue 11 is preferably located on a lower surface of the cylinder head 10, and thus the direction that the molten metal is cast is from the bottom to the top. Accordingly, an overhead gate 22 is formed at the bottom of the conventional sprue 11.

In this case, the molten melt is directionally solidified from the diagonally opposite side of the gate 22 to the gate 22, i.e., solidified from the upper surface to the lower surface of the cylinder head 10.

Moreover, after the molten metal is filled in the mold, the cylinder head 10 is solidified by air cooling through the upper and lower molds 1 and 2.

FIG. 3 is an exemplary perspective view showing a conventional connection pipe. The connection pipe 12 connects a casting furnace to a mold so as to cast molten metal in the casting furnace provided at the bottom to a cavity of the mold. A plurality of sprues 12*a* and 12*b* is preferably formed in the inside of the connection pipe 12 such that the molten metal is cast into the cavity of the mold through the sprues 12*a* and 12*b*.

Preferably, the connection pipe 12 should be kept warm so that the molten metal is cast at a predetermined temperature. Suitably, conventionally, the periphery of the connection pipe 12 is heated by a gas burner.

However, it is difficult to adjust the temperature of the gas burner, and it is also difficult to cool the overheated mold, and the energy cost required to operating the gas burner is high.

FIGS. 4A and 4B are diagrams showing an exemplary structure of a conventional lower mold 13 and, as shown in the figure, the conventional lower mold 13 is of an overhead gate type in which the distance between a combustion chamber 13*b* and a sprue 13*a* is short.

However, there is insufficient space for installing a cooling system for the combustion chamber as shown in the above structure, and the sprue may be clogged in the event of overheating, and the combustion chamber is not cooled.

In particular, as shown in exemplary FIGS. 5A and 5B, a cooling groove 14 is provided at a portion where hot spots are formed on the lower surface of a lower mold 13 to cool the hot spots between the sprues 13*a* by air, and a cooling block 15 assembled with two pipes 16*a* and 16*b* in both directions of the cooling groove 14 is connected to the cooling groove 14. Two inlets and outlets are formed in the up and down direction of the cooling block 15 so that air supplied through a cooling pipe 16*a* provided on one side is introduced through the inlets of the cooling block 15 to cool the lower surface of the lower mold 13 and is then discharged through the outlets of the cooling block 15 to a cooling pipe 16*b* provided on the other side.

The above-described structure can eliminate shrinkage defect; however, the cooling effect is reduced.

Moreover, as shown in exemplary FIGS. 6 and 7, when gas is introduced and discharged through an inlet 18*a* and an outlet 18*b*, formed on the side surface of a conventional mold 17*a*, the gas is not cooled and naturally discharged. Reference numeral 17*b* denotes a mold cover.

FIG. 8 shows a cooling structure of a conventional upper mold, in which air cooling is performed to eliminate shrinkage defect of a spark plug 19; however, the shrinkage defect occurs intermittently, and an upper mold 20 is not efficiently cooled. Reference number 21 is an air cooling pipe.

The above information disclosed in this Background section is only for enhancement of understanding of the background of the invention and therefore it may contain information that does not form the prior art that is already known in this country to a person of ordinary skill in the art.

SUMMARY

In one aspect, the present invention provides a cooling system for a low-pressure casting mold, in which a sprue is located at a side surface of a cylinder head to ensure a sufficient distance between a combustion chamber and the sprue so that a combustion chamber cooling system combined with water cooling and air cooling is provided in a lower mold, thus reducing cycle time. Moreover, the cooling system for a low-pressure casting mold in accordance with the present invention improves mechanical properties of a material used by reducing dendrite arm spacing (DAS) and porosity.

In one embodiment, the present invention provides a cooling system for a low-pressure casting mold preferably including an upper mold, a side mold having a cavity suitably in the middle thereof, and a lower mold such that molten metal is suitably filled and solidified in the cavity to mold a cylinder head, the cooling system preferably comprising: a sprue formed on a side surface of the cylinder head; a first cooling means for cooling the mold by suitably supplying a cooling fluid to the upper mold; a second cooling means for cooling the mold by suitably supplying a cooling fluid to a side mold; and a third cooling means for cooling the mold by suitably supplying a cooling fluid to a lower mold.

In a preferred embodiment, the first cooling means preferably comprises: a housing including a cooling water inlet and a cooling water outlet suitably formed on one side surface thereof, in which a lower portion is suitably attached to an upper surface of the upper mold; a plurality of spark plug pins connected to the cooling water inlet and the cooling water outlet and provided parallel to the vertically downward direction in the inside of the housing; and a cooling line introduced in the horizontal direction and discharged in the opposite direction with the spark plug pins interposed therebetween, wherein cooling water suitably introduced through an inlet of each of the spark plug pins cools the upper mold and is then discharged through the cooling water outlet.

In another preferred embodiment, the second cooling means preferably comprises: a gas inlet and a gas outlet suitably formed in the side mold to discharge gas from the mold; a cooling portion formed between the gas inlet and the gas outlet and preferably receiving a cooling fluid from the outside; a gas suction portion suitably divided by the cooling portion and a partition and preferably connected to the gas inlet so as to suck gas introduced through the gas inlet; a cooling fluid supply path suitably connected to the cooling portion to supply the cooling fluid; and a cooling fluid discharge pipe penetrating from the cooling portion to the gas suction portion and extending to an outlet to discharge the cooling fluid, wherein exhaust gas in the mold is preferably introduced to the gas suction portion through the gas inlet, cooled by the cooling fluid discharge pipe, and then suitably discharged through a gap between the outlet and the cooling fluid discharge pipe.

In still another preferred embodiment, the third cooling means preferably comprises: a cooling fluid supply pipe and a cooling fluid discharge pipe preferably provided parallel or substantially parallel to the vertical direction from the outside to the inside of the lower mold; a three-way valve, preferably provided at an inlet portion of the cooling fluid supply pipe and preferably including a water injection hole formed on an upper portion thereof in the upward direction and a cooling air injection hole suitably formed on a side surface thereof in the horizontal direction; and a discharge pipe suitably connecting the cooling fluid discharge pipe in the horizontal direction, wherein cooling water preferably supplied through the water injection hole and cooling air preferably supplied through the cooling air injection hole move to the cooling fluid supply pipe to cool the lower mold and are then suitably discharged through the cooling fluid discharge pipe and the discharge pipe.

In yet another preferred embodiment, the cooling system further preferably comprises: a housing including a cooling water inlet pipe and a cooling water outlet pipe formed on one side surface thereof and suitably attached to an upper surface of the upper mold; and a plug pin for cooling the inside of the lower mold preferably protruding in the upward direction from the housing, wherein the cooling water is preferably introduced through the cooling water inlet pipe to cool the lower mold and is then suitably discharged through the cooling water discharge pipe.

In still yet another preferred embodiment, the cooling fluid is preferably cooling water or cooling air.

In a further preferred embodiment, the cooling system further preferably comprises: a connection pipe suitably connected to the lower mold and preferably including a sprue formed therein, and an electric heater in which a coil is inserted as a heating element and surrounding the outer circumference of the connection pipe, wherein the connection pipe is kept warm by the electric heater by receiving electric power from the outside.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
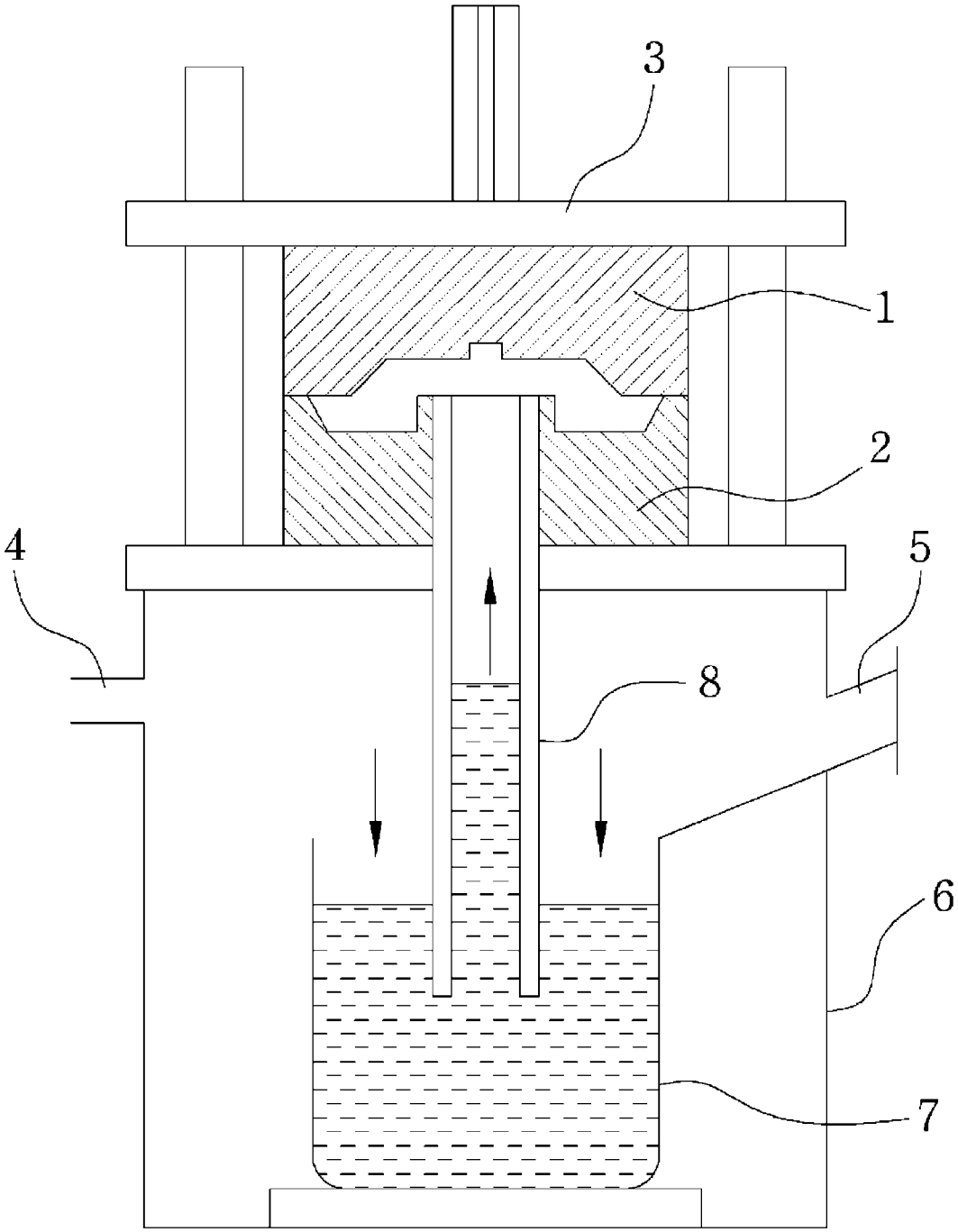
Fig. 1 (PRIOR ART)
FIG. 1 is a schematic diagram showing a conventional low-pressure casting apparatus for aluminum products.
Figure 2:
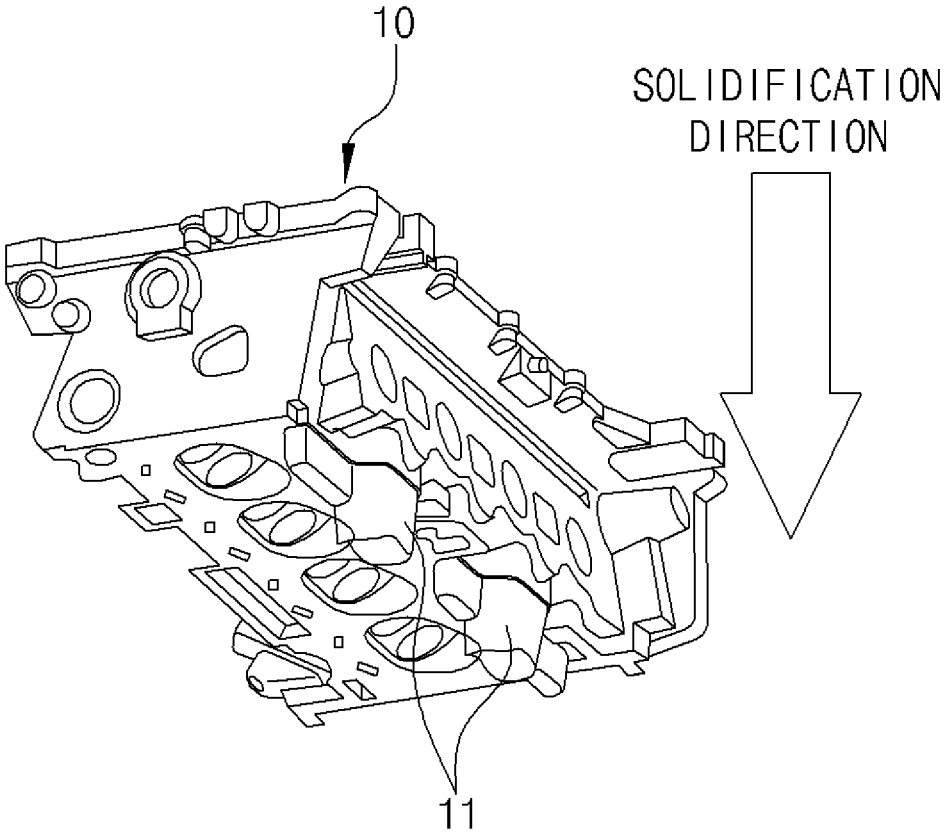
Fig. 2 (PRIOR ART)
FIG. 2 is a diagram showing the position of a conventional sprue.
Figure 3:
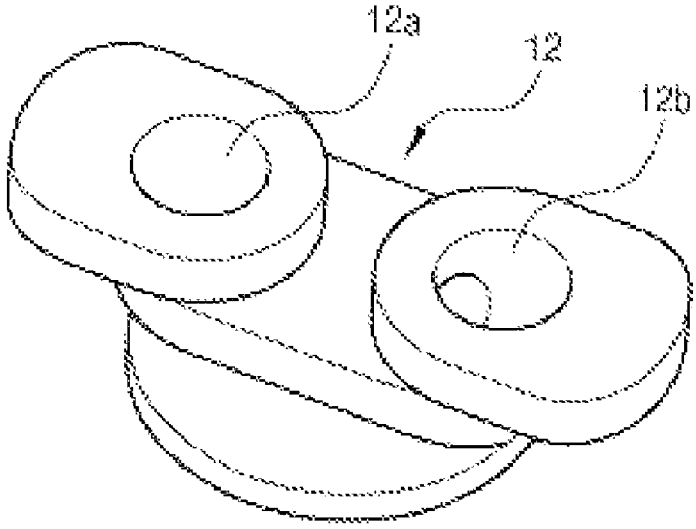
Fig. 3 (PRIOR ART)
FIG. 3 is a perspective view showing a conventional connection pipe.
Figure 4A:
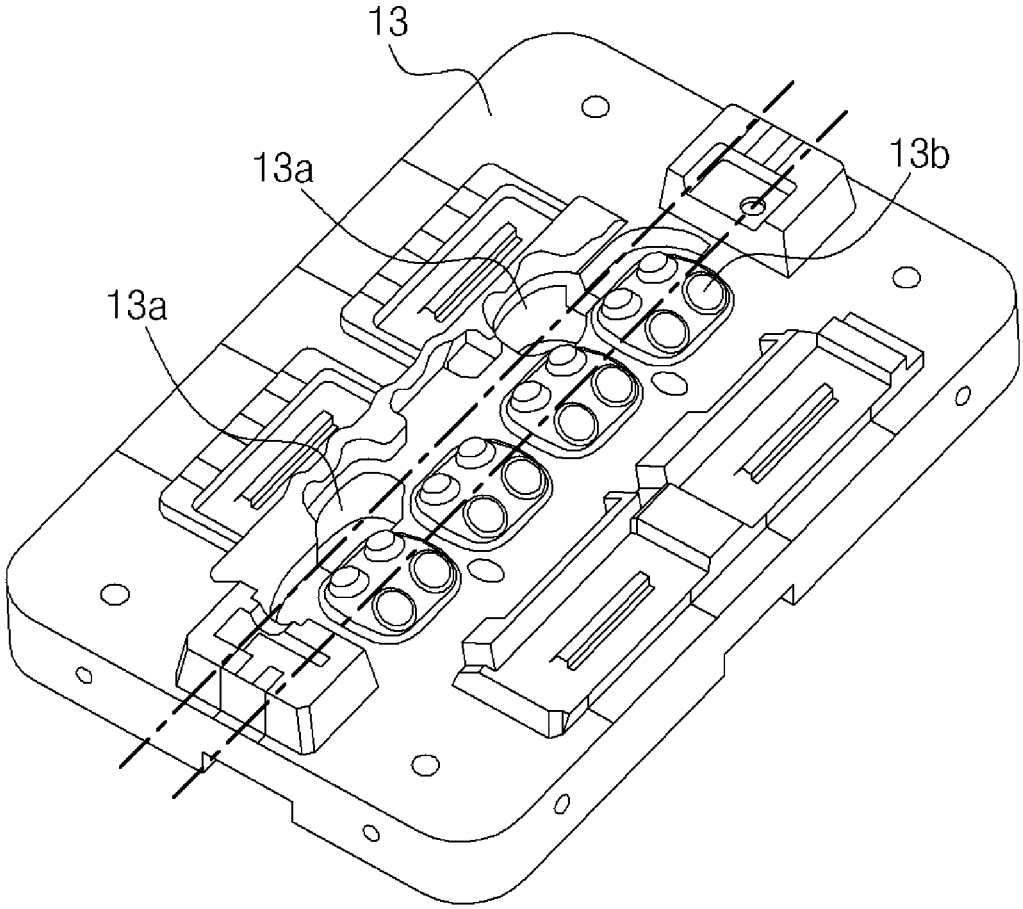
Fig. 4a (PRIOR ART)
FIG. 4A is a diagram showing a conventional lower mold.
Figure 4B:
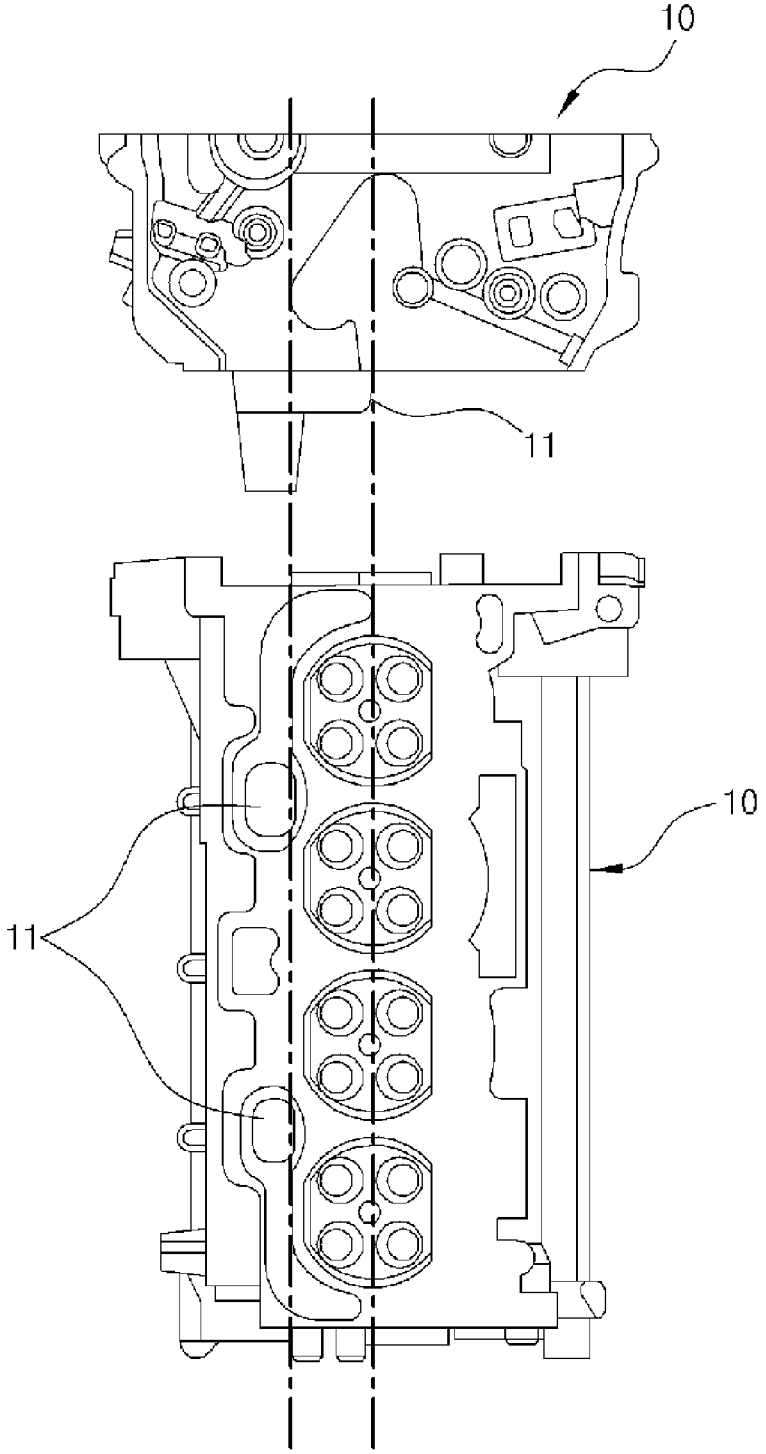
Fig. 4b (PRIOR ART)
FIG. 4B is a side view and a bottom view of FIG. 2.
Figure 5A:
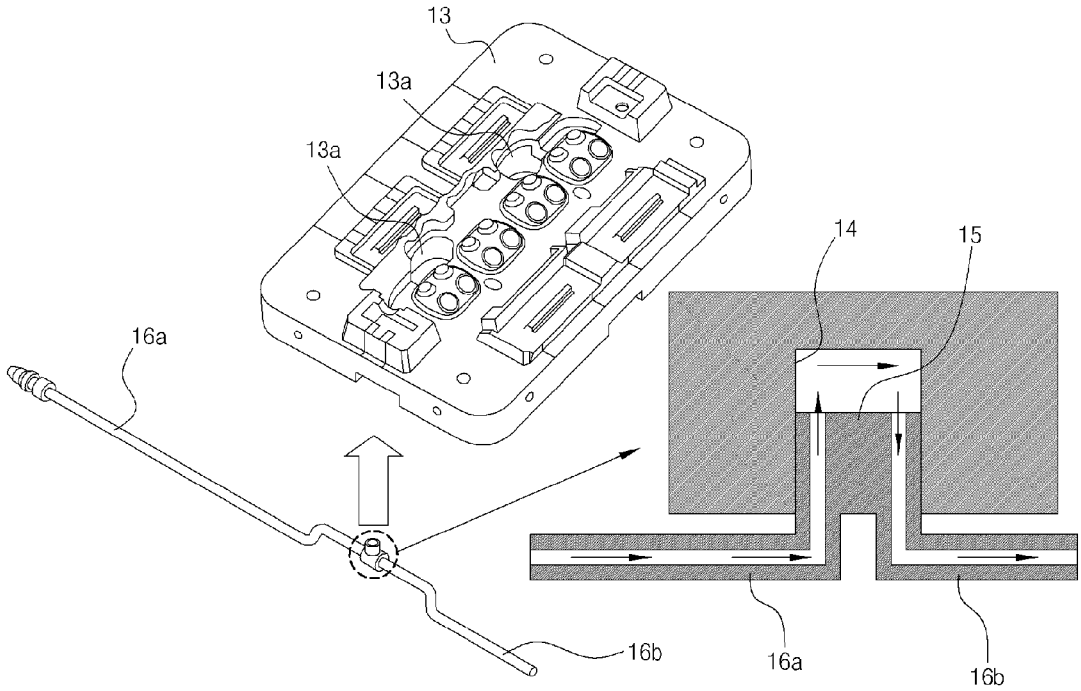
Fig. 5a (PRIOR ART)
FIGS. 5A and 5B are diagrams showing a cooling structure of a conventional lower mold.
Figure 5B:
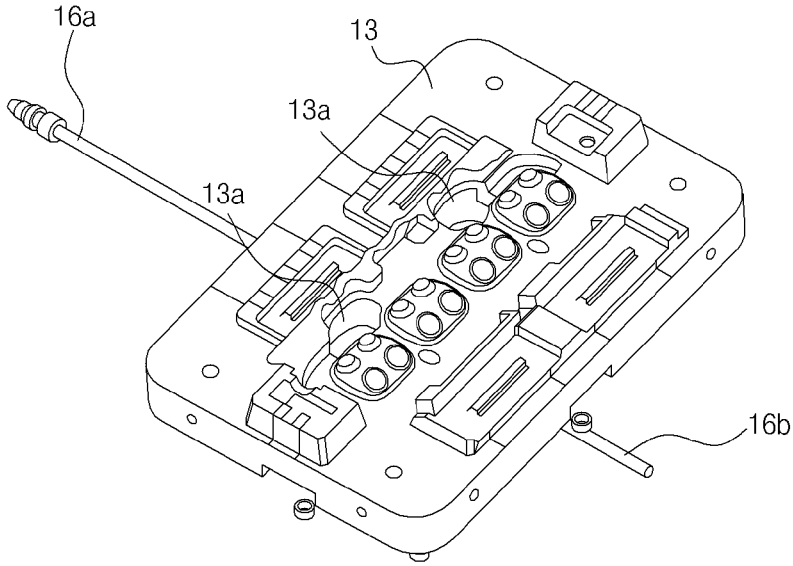
Fig. 5b (PRIOR ART)
Figure 6:
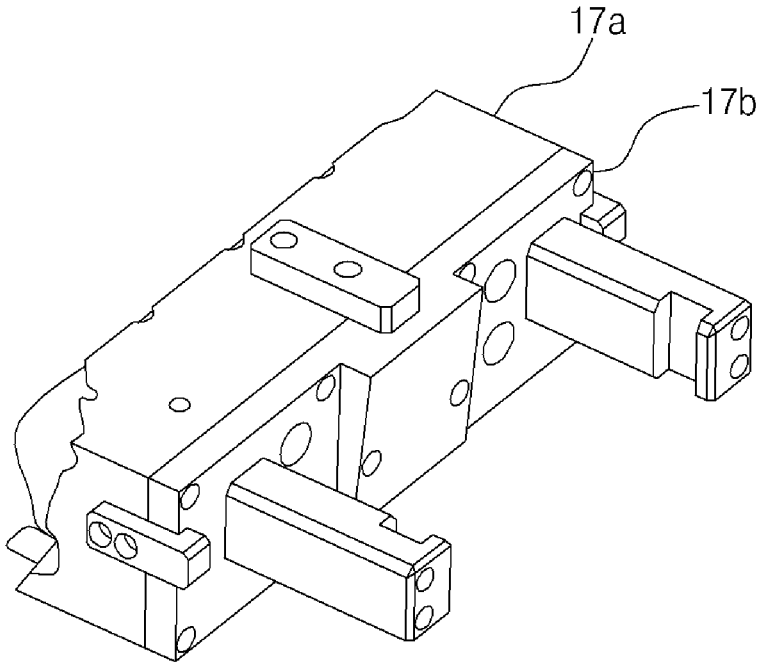
Fig. 6 (PRIOR ART)
FIG. 6 is a perspective view showing a cooling structure of a conventional side mold.
Figure 7:
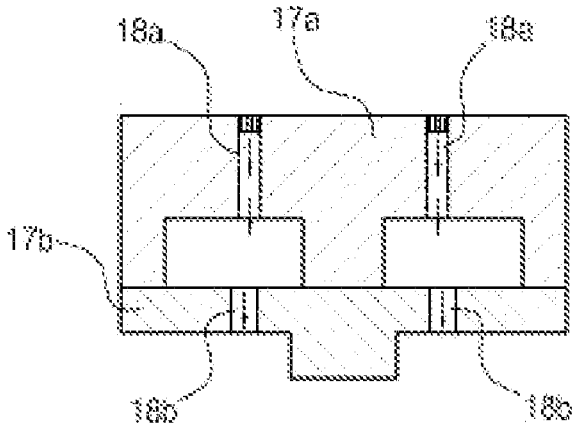
Fig. 7 (PRIOR ART)
FIG. 7 is a cross-sectional view of FIG. 6.
Figure 8:
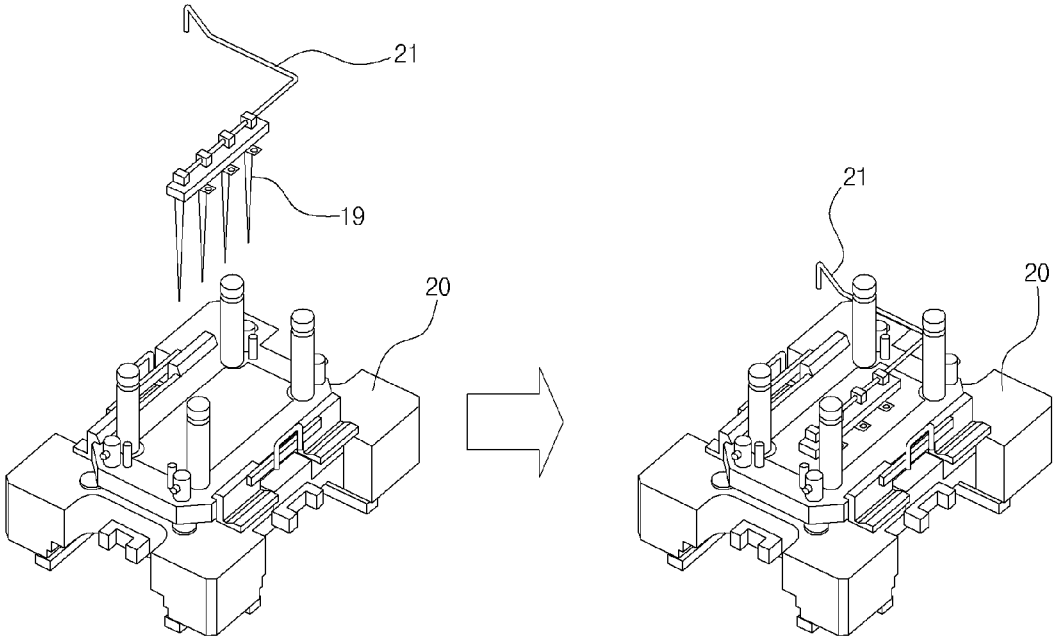
Fig. 8 (PRIOR ART)
FIG. 8 is a diagram showing a cooling structure of a conventional upper mold.
Figure 9:
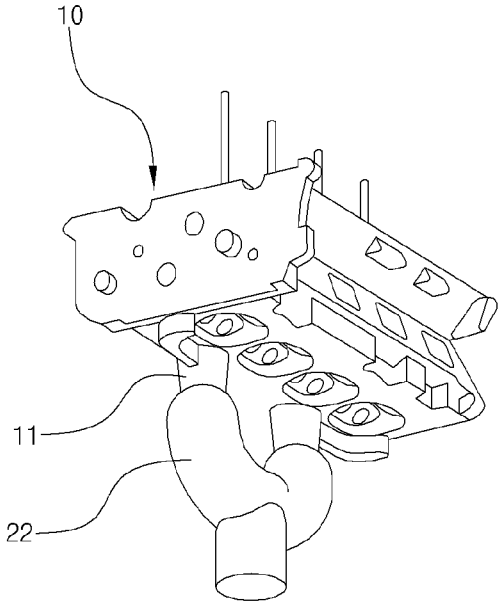
Fig. 9 (PRIOR ART)
FIG. 9 is a diagram viewed from the rear side of FIG. 2.

| | |
|---|---|
| 101: sprue | 102: cylinder head |
| 103: combustion chamber | 104: lower mold |
| 105: connection pipe | 106: electric heater |
| 107: bolt | 108: power input terminal |
| 110: combustion chamber cooling system | |
| 111: cooling fluid supply pipe | 112: cooling fluid discharge pipe |
| 113: three-way valve | 114: water injection hole |
| 115: air injection hole | 116, 132: housing |
| 117: lower plug | 118: plug pin |
| 119: inlet pipe | 120: discharge pipe |
| 121: side mold | 122: inlet |
| 123: outlet | 124: rear cover |
| 125: cooling portion | 126: gas suction portion |
| 127: cooling air discharge pipe | 128: cooling air supply path |
| 130: upper mold | 131: spark plug pin |
| 133: cooling water inlet pipe | 134: cooling water outlet pipe |
| 135: cooling line | |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

As described herein, the invention includes a cooling system for a low-pressure casting mold including an upper mold, a side mold having a cavity in the middle thereof, and a lower mold such that molten metal is filled and solidified in the cavity to mold a cylinder head, the cooling system comprising a sprue and a first cooling means for cooling the mold.

In one embodiment of the invention, the sprue is formed on a side surface of the cylinder head. In another embodiment of the invention, the first cooling means for cooling the mold supplies a cooling fluid to the upper mold.

In another embodiment, the cooling system for a low-pressure casting mold as described herein, further comprises a second cooling means for cooling the mold. In one embodiment, the second cooling means for cooling the mold supplies a cooling fluid to a side mold.

In another embodiment, the cooling system for a low-pressure casting mold of the invention as described herein, further comprises a third cooling means for cooling the mold. In one particular embodiment, the third cooling means for cooling the mold supplies a cooling fluid to a lower mold.

The invention can also include a motor vehicle comprising a cooling system for a low-pressure casting mold as described in any one of the above-mentioned aspects.

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

FIGS. 10 to 24 are diagrams illustrating exemplary configuration and operation of the present invention and the analysis results.

Figure 10:
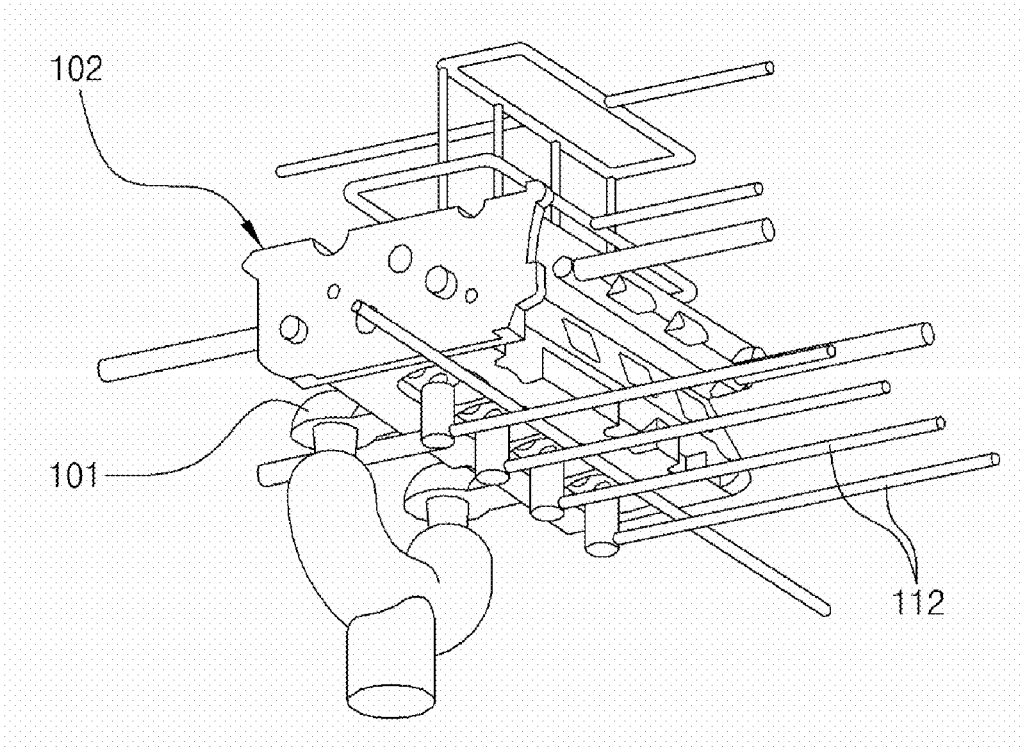
FIG. 10 is a diagram showing the position of a sprue in accordance with the present invention.
Figure 11:
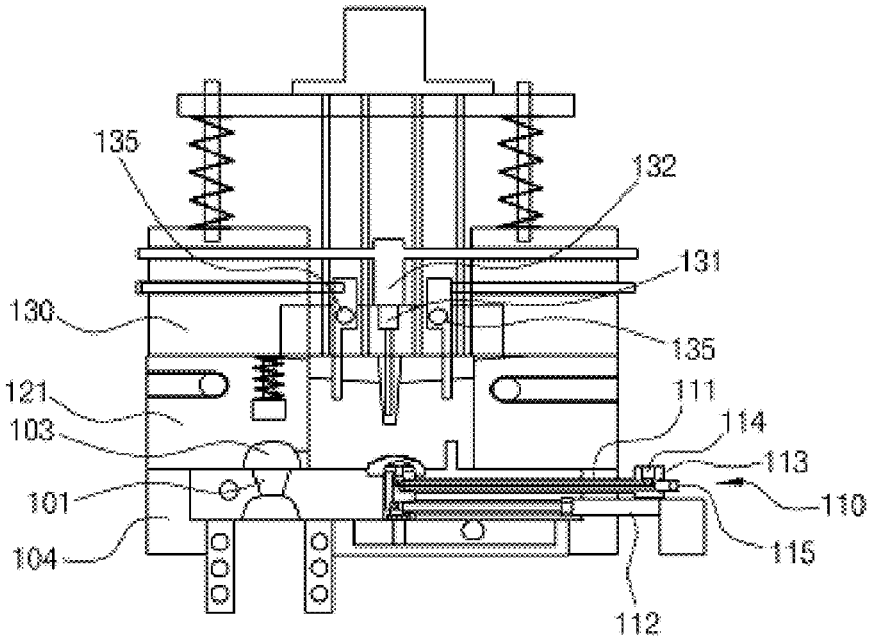
FIG. 11 is a cross-sectional view of a low-pressure casting mold for a cylinder head in accordance with a preferred embodiment of the present invention.

In preferred embodiments, a sprue 101 in accordance with the present invention is preferably located on the side surface of a cylinder head 102 (FIG. 10). Accordingly, the distance between a combustion chamber 103 and the sprue 101 is suitably ensured, and thus it is possible to preferably install an additional cooling system therebetween (side gate type), compared with the conventional sprue located at the bottom of the cylinder head 102.

Figure 12:
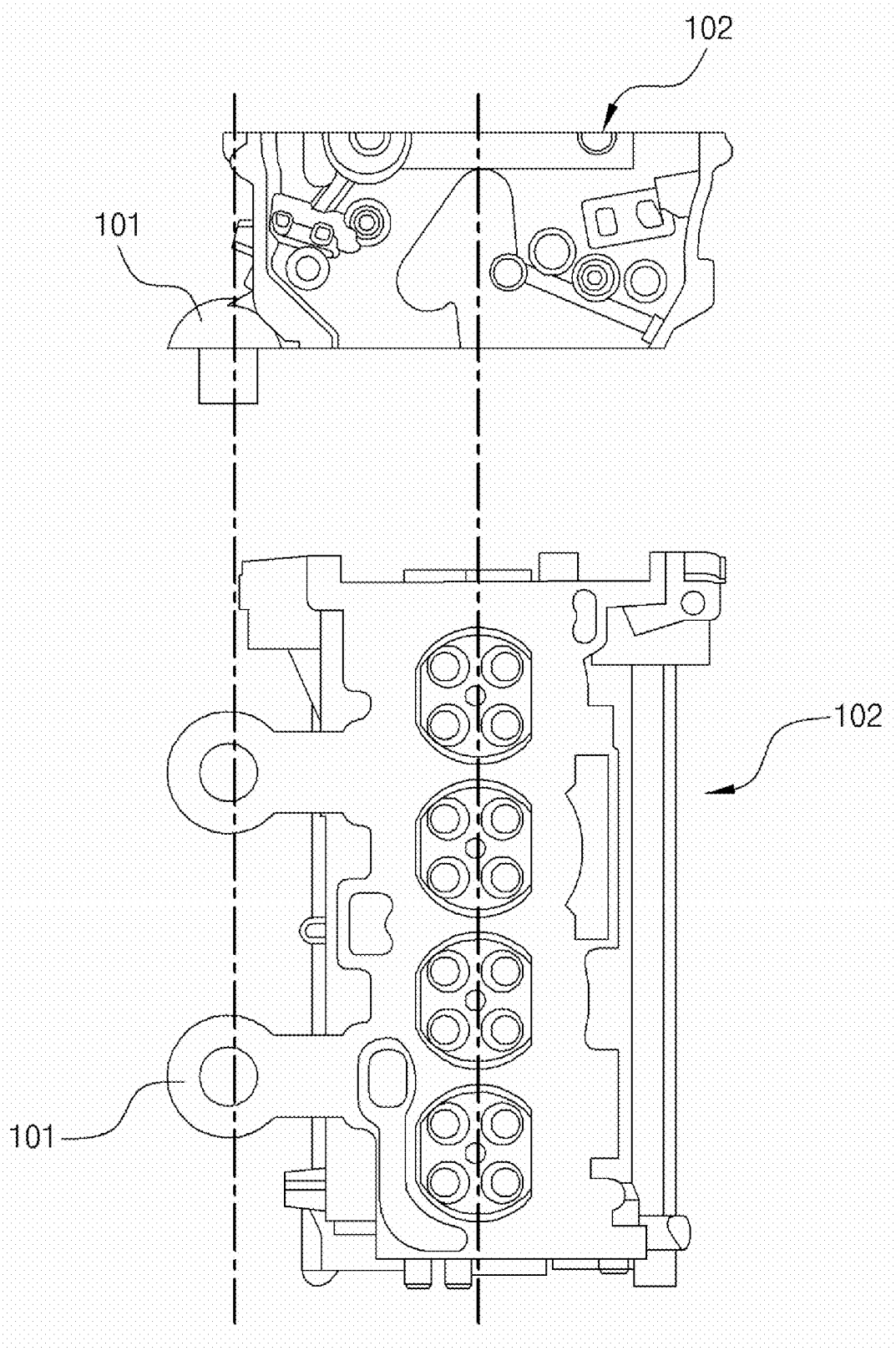
FIG. 12 is a side view and a bottom view of a cylinder head in accordance with the present invention.
Figure 19:
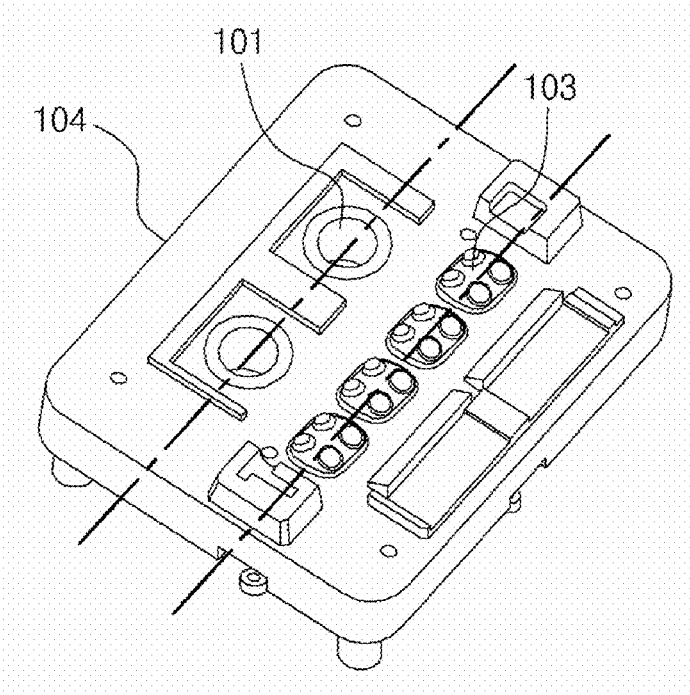
FIG. 19 is a perspective view showing a lower mold in accordance with the present invention.
Figure 20:
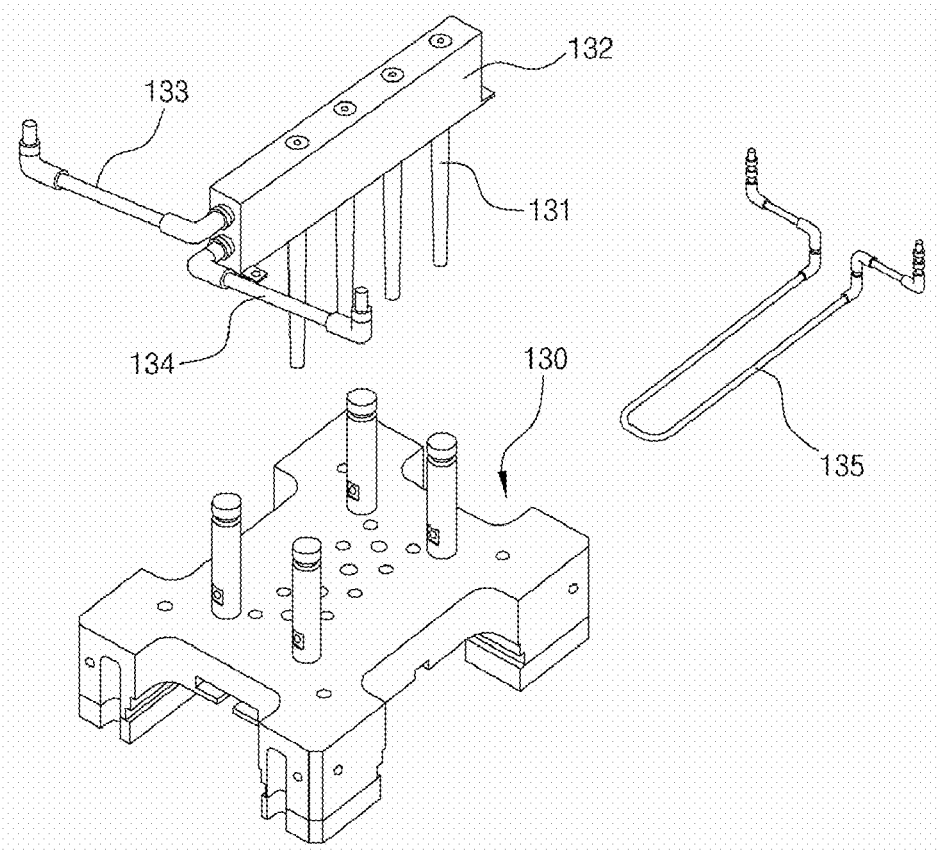
FIG. 20 is an exploded view showing a cooling structure of an upper mold in accordance with the present invention.
Figure 21:
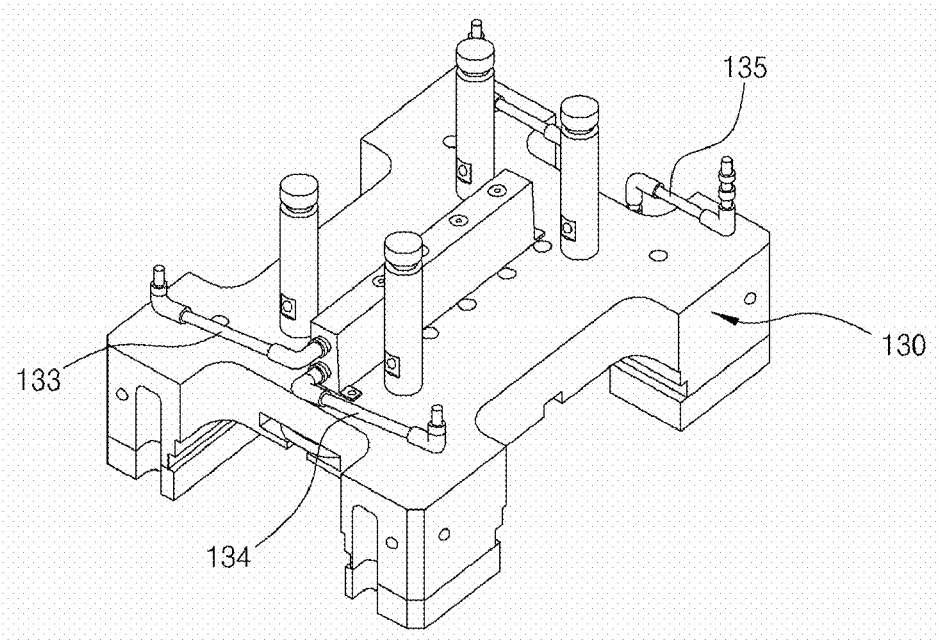
FIG. 21 is an assembly diagram of FIG. 20.

Moreover, as shown in FIGS. 12 and 19, in the case where the sprue 101 is preferably located on the side surface of the cylinder head 102, it is possible to prevent the sprue 101 from being clogged even in the event that the sprue 101 is overcooled during solidification of molten metal. That is, since the distance between the conventional sprue and the combustion chamber is suitably short and thus the solidification direction is suitably close to the vertical direction, the sprue is also solidified and clogged when it is overcooled to increase the cooling rate during the solidification process; however, in the present invention, since the sprue 101 is preferably at a longer distance from the combustion chamber 103 than the conventional sprue and the molten metal is preferably cast in the lateral direction, not from the bottom to the top, the casting direction is suitably different from the solidification direction, and it is thus possible to prevent the sprue 101 from being clogged even in the event of overcooling.

Figure 13:
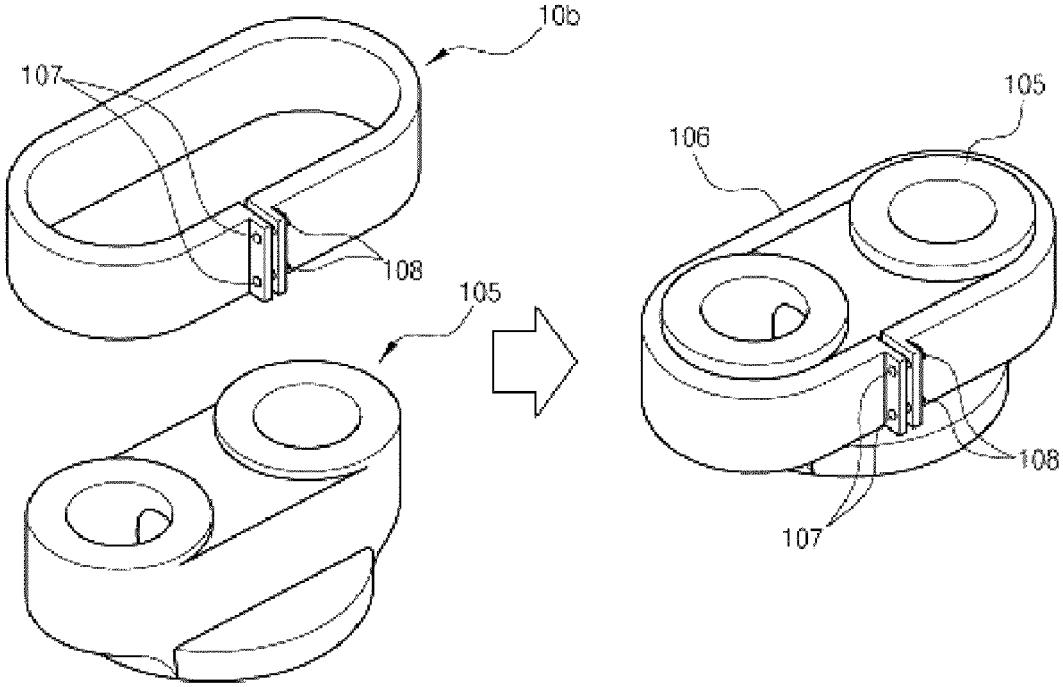
FIG. 13 is a configuration diagram showing a temperature keeping structure of a connection pipe in accordance with the present invention.

As shown in exemplary FIG. 13, a connection pipe 105 in accordance with the present invention is kept suitably warm using an electric heater 106. According to preferred embodiments, the electric heater 106 has a tubular structure that surrounds the outer circumference of the connection pipe 105. Preferably, a coil is inserted in the electric heater 106 and, when electric power is suitably applied from the outside, the coil acts as a heating element to generate heat, thus suitably heating the connection pipe 105.

According to preferred embodiments, one side of the electric heater 106 may be cut and opened so that the connection pipe 105 is preferably inserted therein through the opened gap. After the connection pipe 105 is suitably inserted therein, the electric heater 106 may be fastened by means of bolts 107 through penetration holes formed on both ends thereof. Moreover, a power input terminal 108 is preferably formed on one end to receive electric power from the outside.

According to preferred embodiments, the electric heater 106 with the above-described structure can automatically control the temperature and, since it is formed of an insulating material and thus it does not apply heat to the mold, in preferred embodiments it can advantageously cool the mold. Moreover, in further preferred embodiments, it is possible to save energy.

Next, a cooling structure of a lower mold 104 according to further preferred embodiments will be described.

Figure 14A:
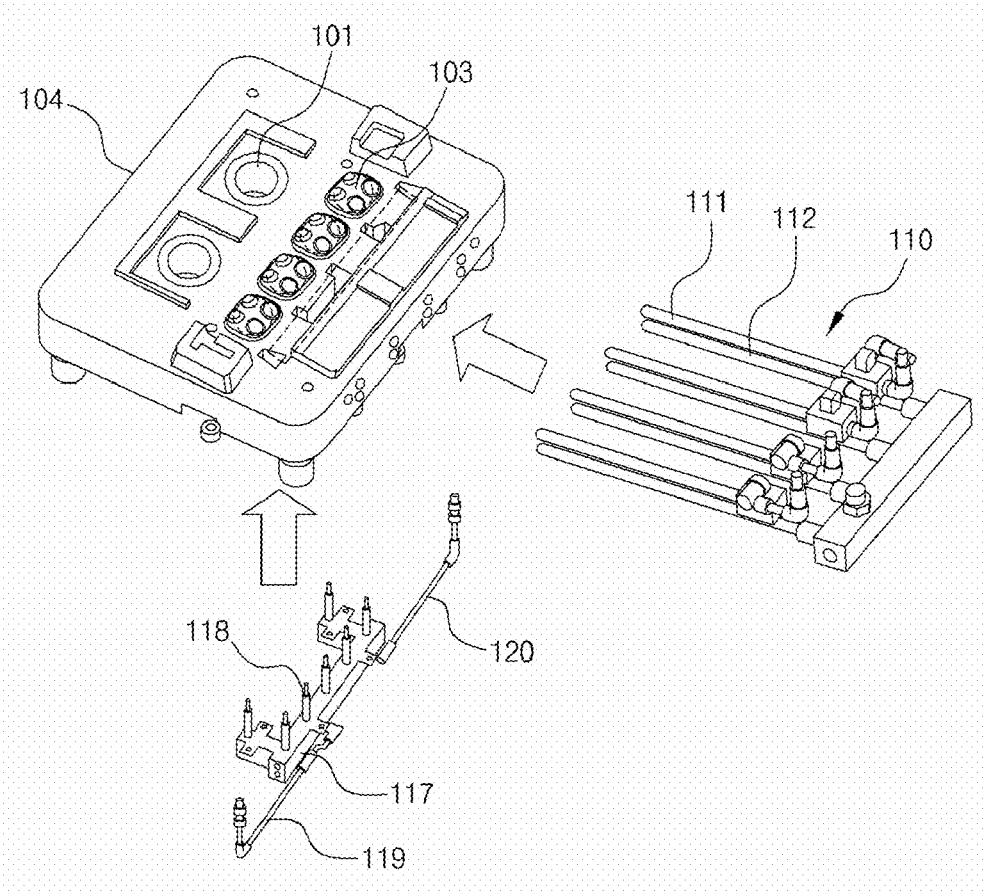
FIGS. 14A and 14B are configuration diagrams showing a cooling structure of a lower mold in accordance with the preferred embodiment of the present invention.
Figure 14B:
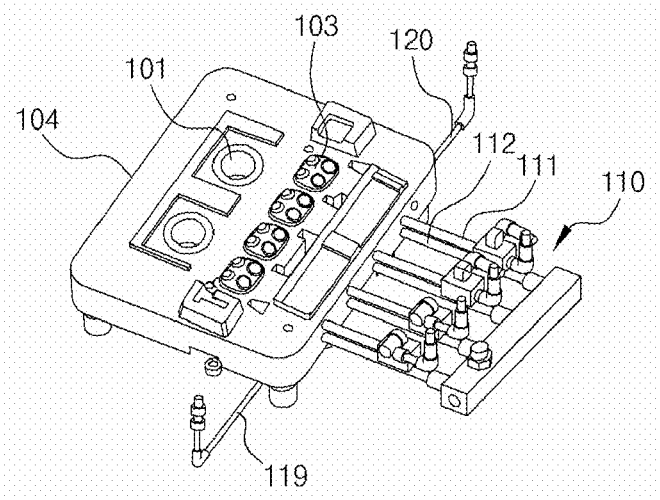
Figure 15A:
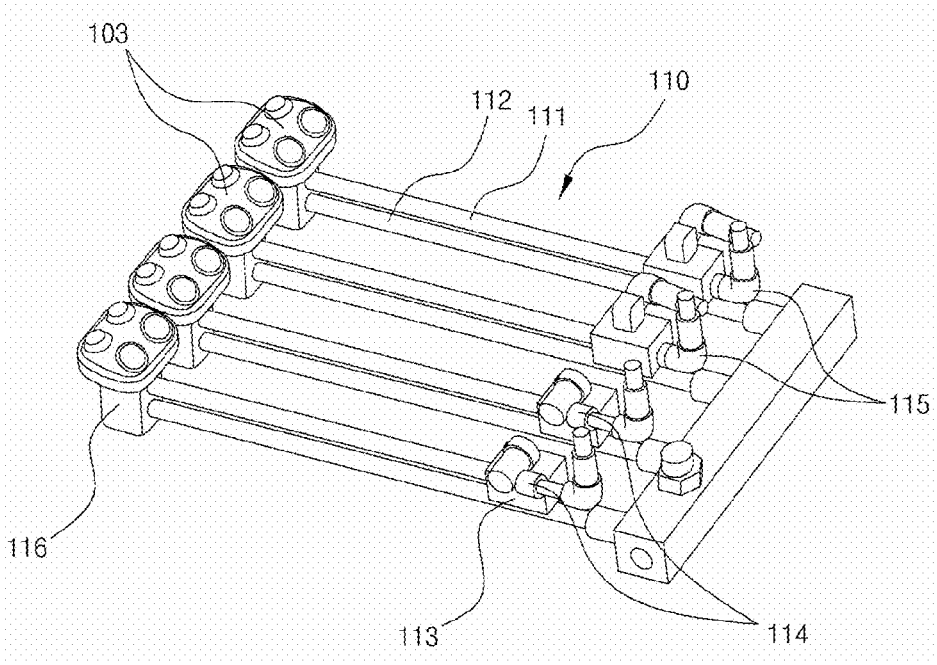
FIG. 15A and 15B are a perspective view and a side view showing a combustion chamber cooling system of FIG. 14A.
Figure 15B:
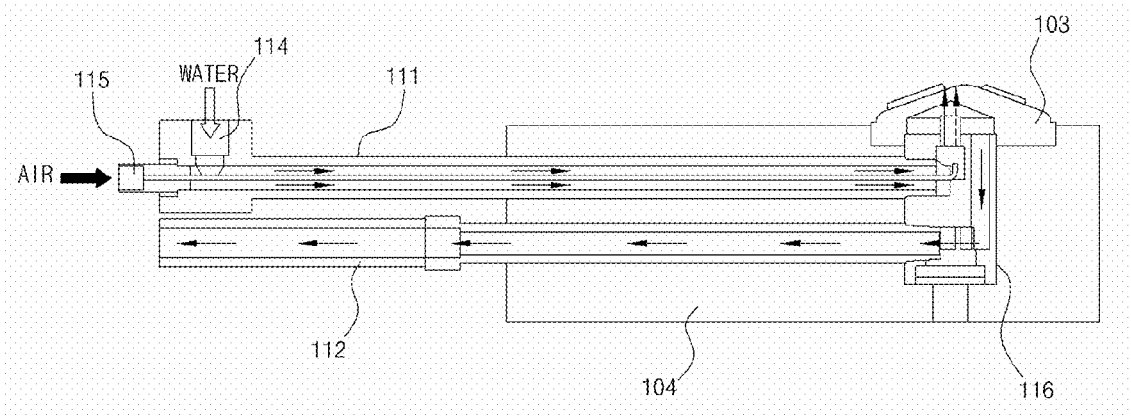
Figure 16:
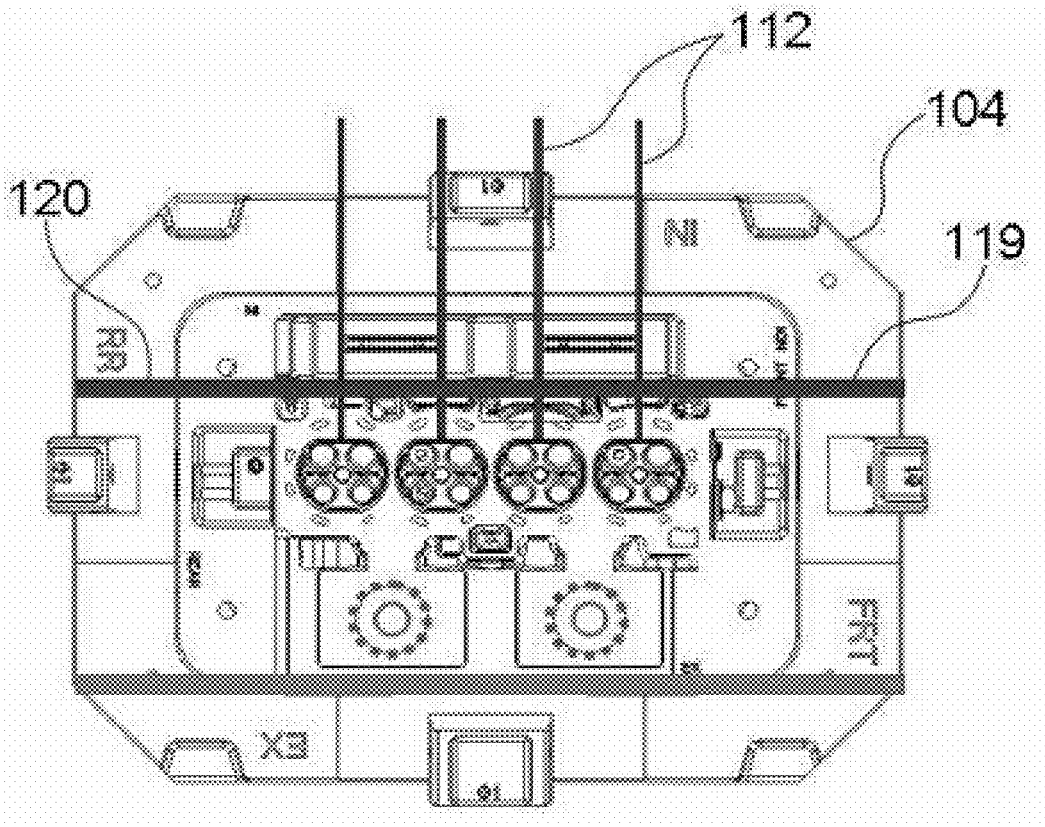
FIG. 16 is a bottom view of FIG. 10.

As shown in exemplary FIGS. 14 to 16, a preferred embodiment of the present invention provides a combustion chamber cooling system 110 for suitably cooling the lower portion of a lower mold 104, particularly, the lower portion of the combustion chamber 103 of the cylinder head 102.

According to certain embodiments, the combustion chamber cooling system 110 has a preferred structure in which each of a plurality of cooling fluid supply pipes 111 is independently suitably connected to the combustion chamber 103 so that a cooling fluid is preferably supplied through the cooling fluid supply pipes 111 to cool the cylinder head 102.

According to further preferred embodiments, the combustion chamber cooling system 110 preferably includes a three-way valve 113 suitably provided at an end of each of the cooling fluid supply pipes 111, a water injection hole 114 suitably provided at the top of the 3-way valve 113, and an air injection hole 115 suitably provided on the side surface of the 3-way valve 113. Preferably, according to further embodiments, water supplied to the water injection hole 114 and air supplied to the air injection hole 115 are preferably introduced through the cooling fluid supply pipes 111 to suitably cool the combustion chamber 103 and then suitably discharged through cooling fluid discharge pipes 112.

According to further preferred embodiments, the end portions of the cooling fluid supply pipes 111 supplying water and air to the combustion chamber 103 and the cooling fluid discharge pipes 112 are preferably covered by a housing 116, and, in further embodiments, a plug is suitably installed at the bottom of the housing 116 to prevent water leakage.

In other embodiments, at the lower portion of the lower mold 104, a lower plug 117 preferably formed in substantially the horizontal direction and a plug pin 118 are installed around the combustion chamber 103 such that the lower mold 104 is suitably water-cooled through the lower plug pin 118. Reference numeral 119 denotes an inlet pipe and 120 denotes a discharge pipe.

Next, a cooling structure of a side mold 121 in accordance with preferred embodiments of the present invention will be described.

Figure 17:
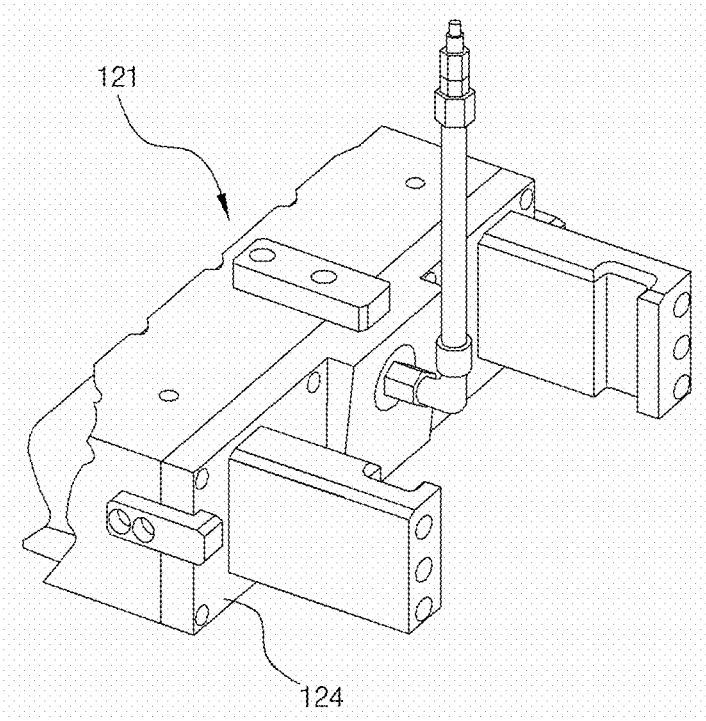
FIG. 17 is a perspective view showing a cooling structure of a side mold in accordance with the present invention.
Figure 18:
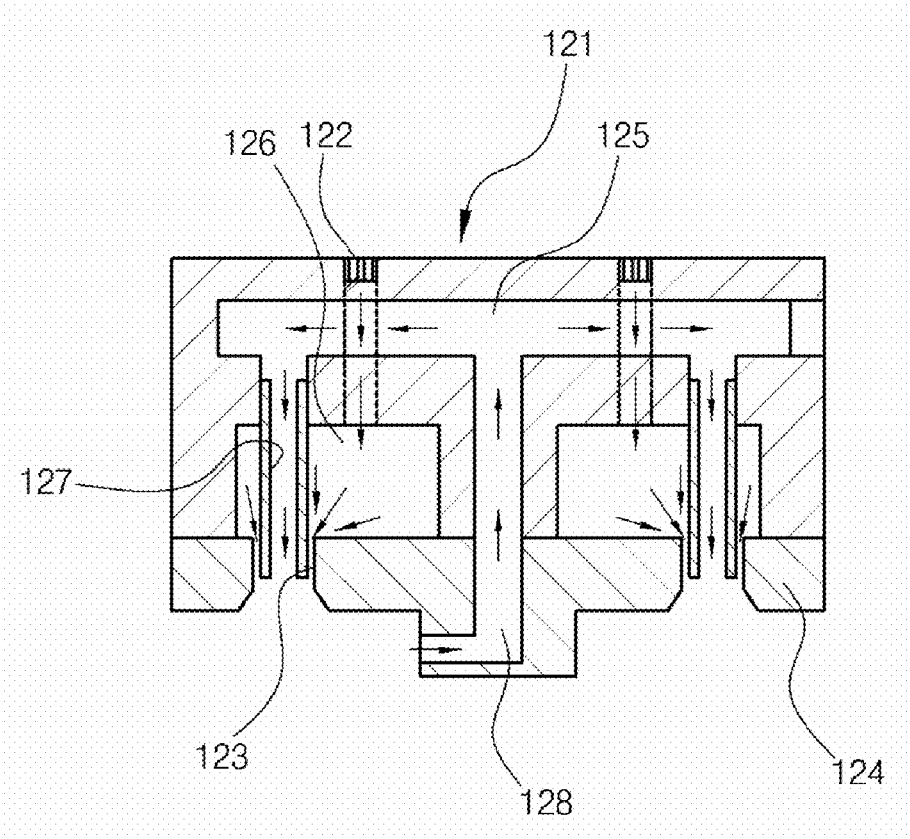
FIG. 18 is a cross-sectional view of FIG. 17.

As shown in exemplary FIGS. 17 and 18, an inlet 122 and an outlet 123 are preferably formed on the side surface of the side mold 121, and a rear cover 124 is preferably provided on the rear surface of the side mold 121. In preferred embodiments, the side mold 121 preferably includes a cooling portion 125 suitably formed in the horizontal direction therein and a cooling air supply path 128 suitably formed in the vertical direction through the rear cover 124 to the cooling portion 125.

Furthermore, according to exemplary embodiments, the side mold 121 includes penetration holes formed on both ends of the cooling portion 125, a cooling air discharge pipe 127 inserted into the penetration hole, a gas suction portion 126 divided by a partition, and the outlet 123 formed on both ends of the rear cover 124. Accordingly, the gas suction portion 126 is suitably divided into two parts with the cooling air supply path 128 interposed therebetween, and in further embodiments, preferably, a rear opening portion thereof is covered by the rear cover 124.

In other embodiments of the invention as described herein, a front portion of the cooling air discharge pipe 127 preferably inserted into the penetration hole suitably penetrates the gas suction portion 126 and a rear portion of the cooling air discharge pipe 127 is preferably connected to the outlet 123 such that cooling air preferably introduced through the cooling air supply path 128 is suitably discharged to the outside through the cooling portion 125, the cooling air discharge pipe 127, and the outlet 123.

In other certain embodiments, gas preferably introduced through the inlet 122 formed on the side surface of the side mold 121 is suitably discharged to the outlet 123 together with the cooling air through the gas suction portion 126. Preferably, since the gas outlet 123 has a diameter suitably greater than that of the cooling air discharge pipe 127, the air preferably introduced through the gas suction portion 126 passes through the outlet 123 along the outer surface of the cooling air discharge pipe 127, and the cooling air of the cooling air discharge pipe 127 is suitably directly discharged through the outlet 123.

Preferably, when the air introduced through the gas suction portion 126 is suitably introduced from the large space into a narrow gap between the cooling air discharge pipe 127 and the outlet 123, the velocity of the fluid is suitably increased and the pressure is reduced (Bernoulli's theorem). As a result, in further preferred embodiments, the air is preferably discharged through the outlet 123 by Venturi action and the introduced gas is suitably widely distributed.

Accordingly, in further embodiments, the side mold 121 in accordance with preferred embodiments of the present invention is preferably cooled by the cooling air and the discharge gas is also cooled by the cooling air and then discharged.

Next, a cooling structure of an upper mold 130 in accordance with preferred embodiments of the present invention will be described.

Conventionally, the upper mold is cooled by air cooling through a spark plug pin (separate type) preferably provided on the top of the upper mold; however, according to preferred embodiments of the present invention, the spark plug pin 131 is preferably cooled by water cooling and an upper end portion of the spark plug pin 131 is suitably integrally formed with a housing 132. According to certain preferred embodiments, a cooling water inlet pipe 133 and a cooling water outlet pipe 134 are suitably formed on one side surface of the housing 132 so that cooling water preferably introduced through the cooling water inlet pipe 133 cools the spark plug pin 131 and is then suitably discharged through the cooling water outlet pipe 134 to be circulated.

In further embodiments, a U-shaped cooling line 135 is preferably provided on the lower surface of the upper mold 130 such that the cooling water preferably introduced through one end portion of the cooling line 135 suitably cools the upper mold 130 and is then suitably discharged through the other end portion of the cooling line 135.

As described in other preferred aspects of the invention, the cooling system for the low-pressure casting mold for the cylinder head 102 in accordance with the present invention preferably has a structure that the sprue 101 is preferably located on the side surface of the cylinder head 102 and the mold is preferably cooled by water cooling and air cooling. In further embodiments as described herein, exemplary filling, solidification and microstructural behavior before and after the cooling technique of the present invention was applied were simulated and analyzed, and the results are as follows.

Figure 22A:
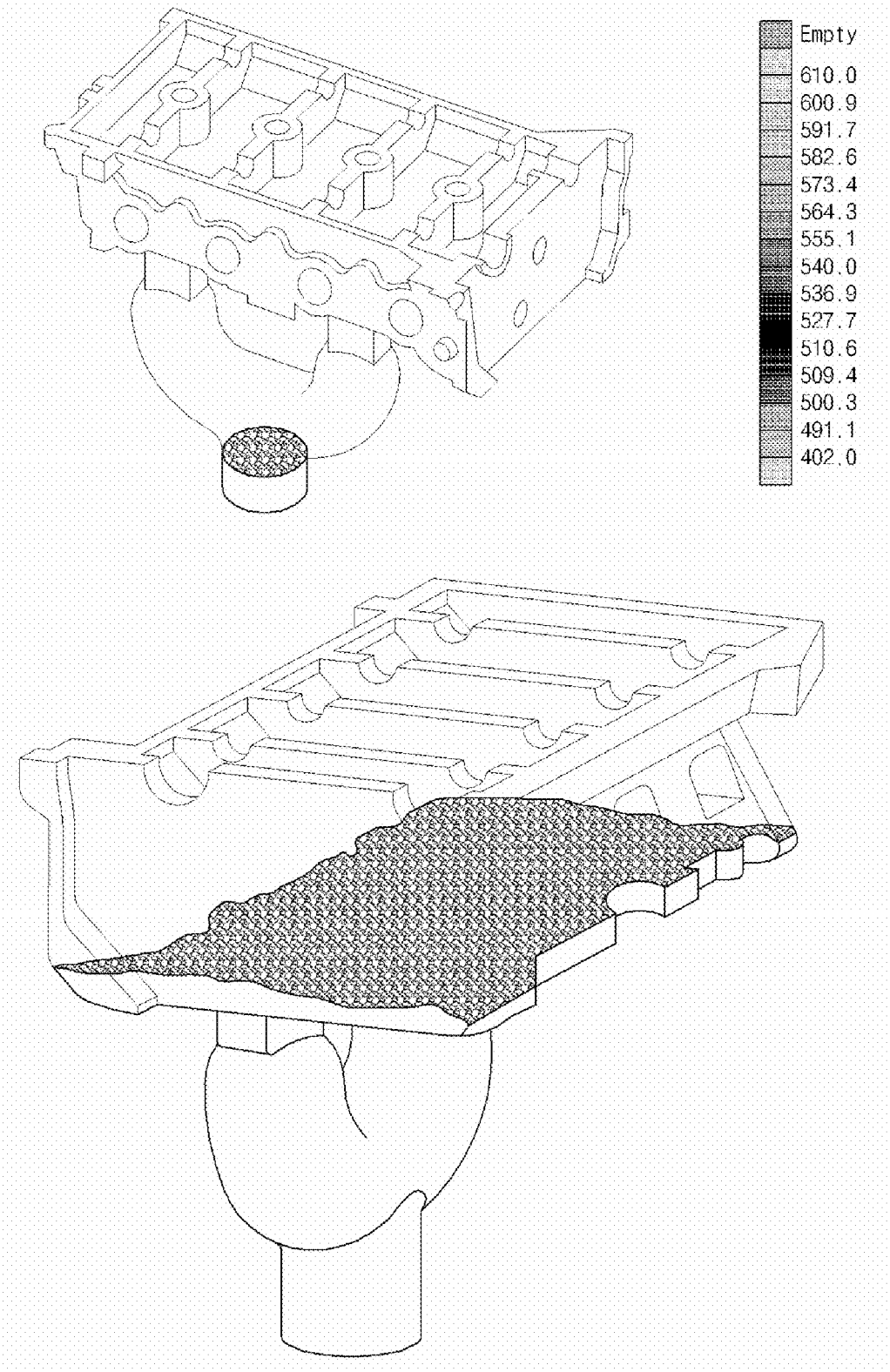
FIGS. 22A and 22B are diagrams showing the results of a filling analysis according to a simulation conducted by a conventional technique and by the present invention.
Figure 22B:
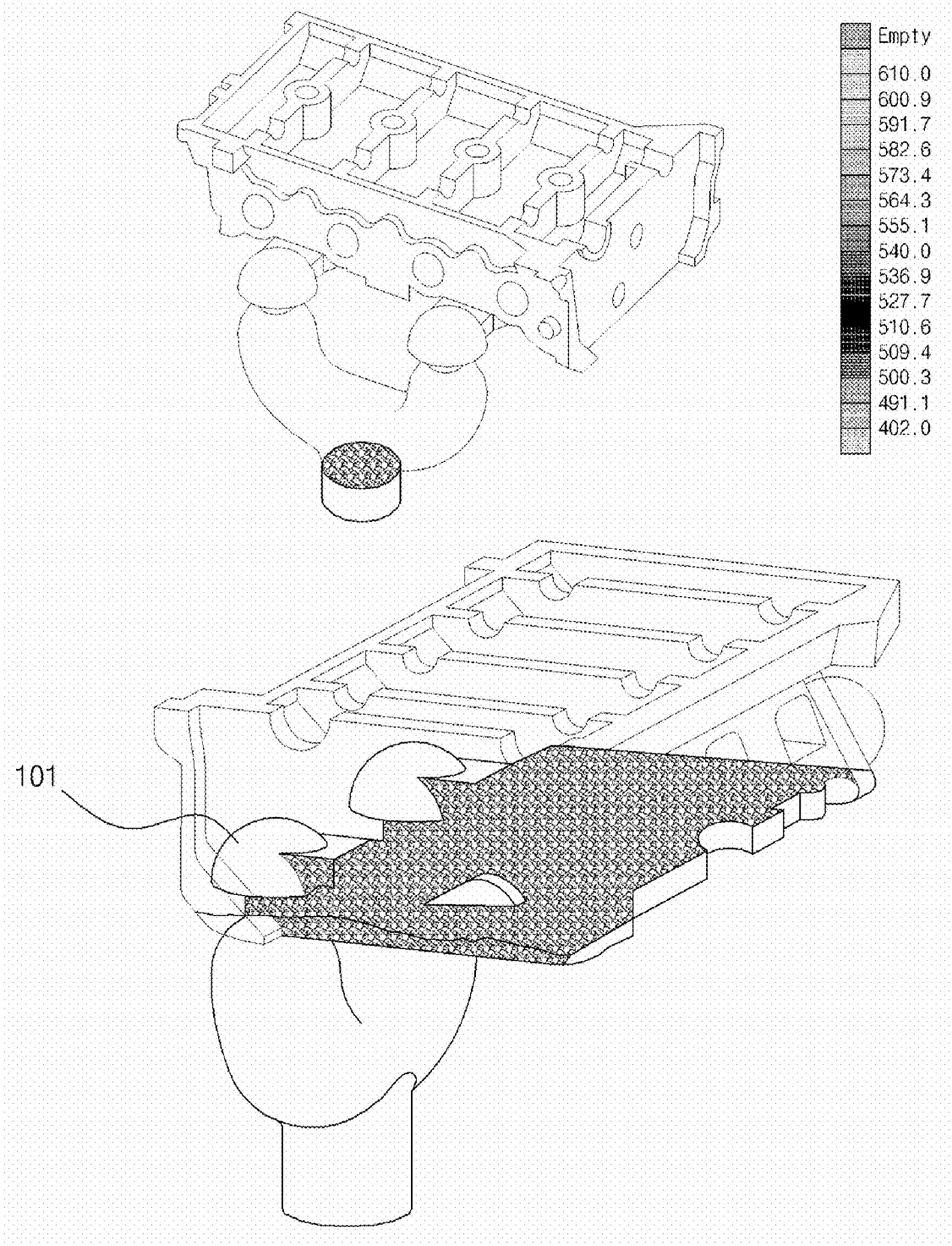

As shown in FIGS. 22A and 22B, the conventional system, in which the sprue 11 is located on the lower surface of the cylinder head and to which air cooling is applied (FIG. 22A), and the present invention, in which the sprue 101 is preferably located on the side surface of the cylinder head 102 and to which water cooling and air cooling are preferably applied (FIG. 22B), all showed the suitable laminar flow filling upon casting, and it was further found according to certain embodiments that the possibility of occurrence of bubbles due to a warm current was low.

Figure 23A:
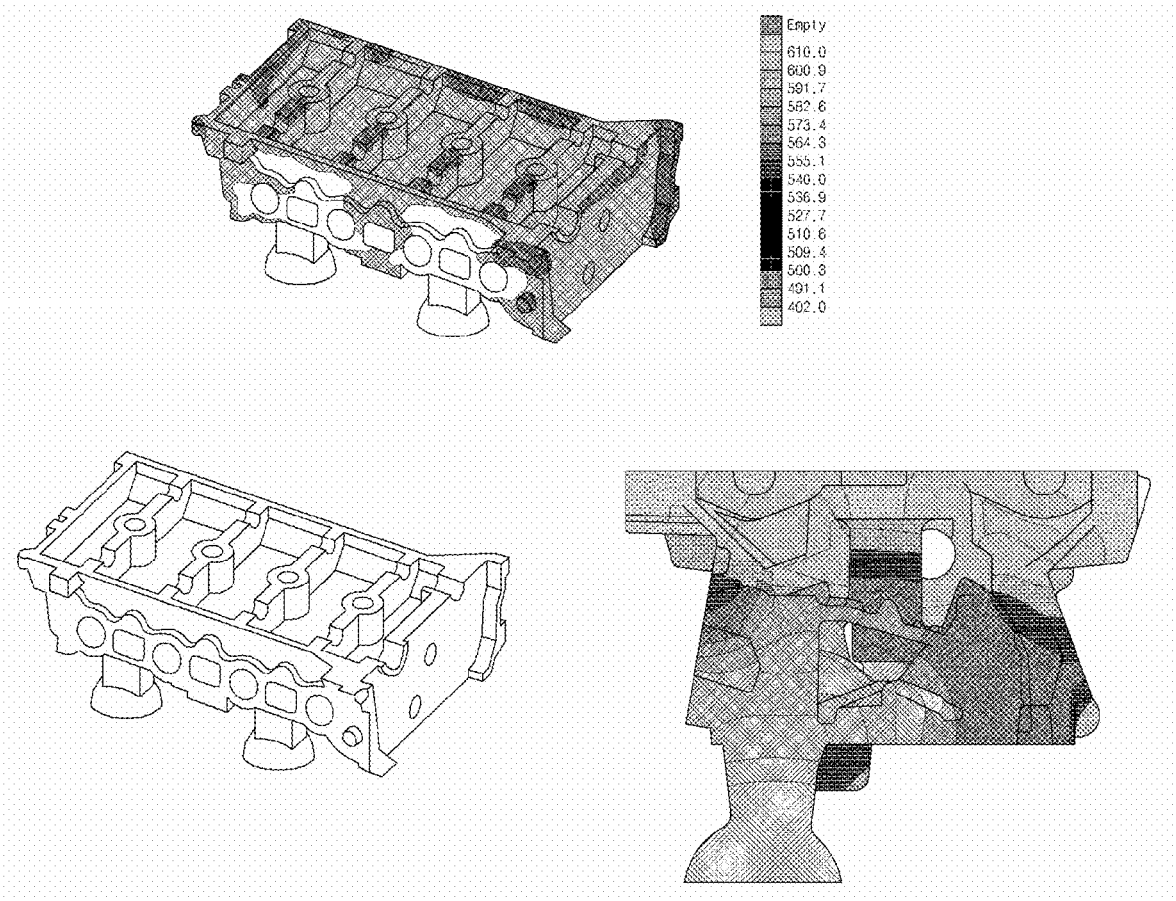
FIGS. 23A and 23B are diagrams showing the results of a solidification analysis according to a simulation conducted by a conventional technique and by the present invention.
Figure 23B:
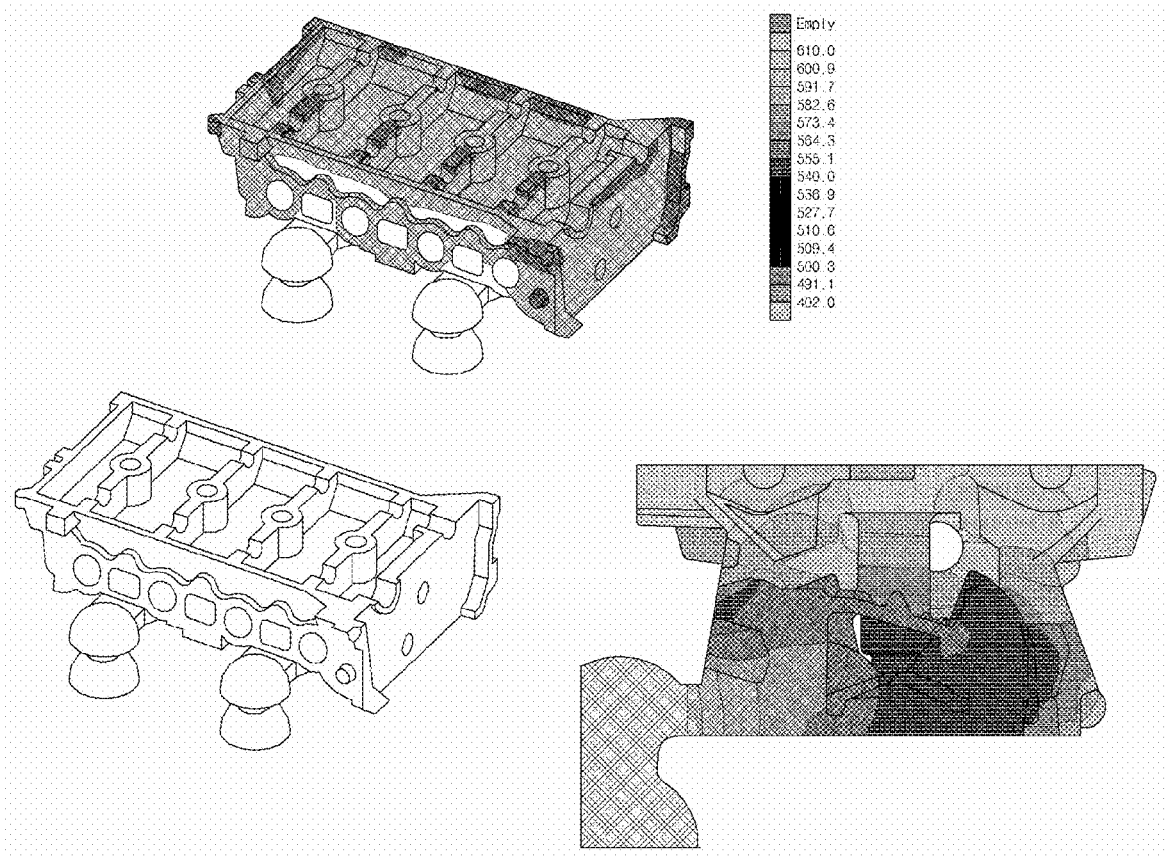

As shown in FIGS. 23A and 23B, the conventional system (FIG. 23A) and the present invention (FIG. 23B) preferably showed the solidification of the liquid fraction of more than 50% and, in case of the conventional system, shrinkage defects were found in the mounting holes of the spark plugs, the assembly holes of the cylinder head bolts, the assembly holes of a cam cap, and the assembly holes of the head cover; however, in case of the present invention, the shrinkage defect was reduced by 30%.

Moreover, in both the conventional system and the present invention, the molten metal was solidified from the opposite direction of the gate position (directional solidification), i.e., solidified from the upper surface of the cylinder head, and the solidification time in the present invention was reduced by about 100 seconds compared with the conventional system.

Figure 24:
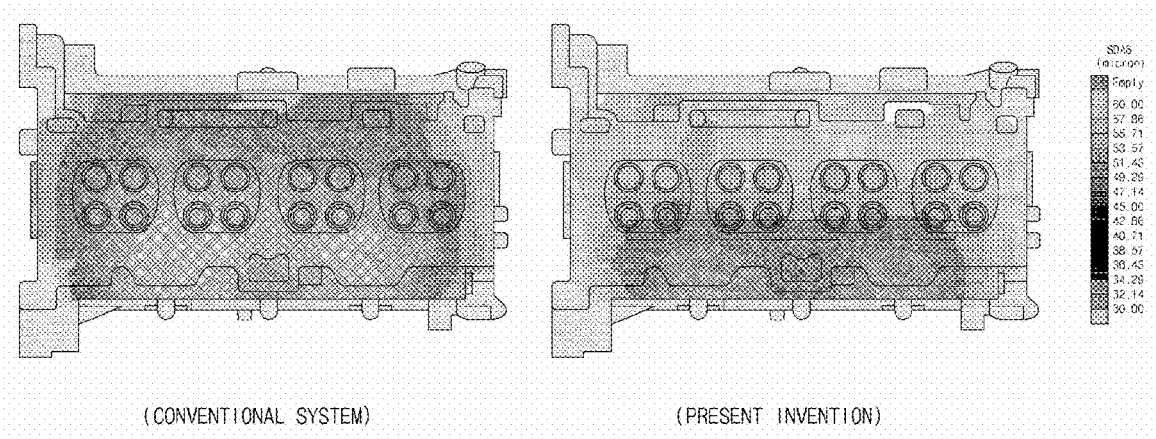
FIG. 24 is a diagram showing the results of a DAS analysis according to a simulation conducted by a conventional technique and by the present invention Reference numerals set forth in the Drawings includes reference to the following elements as further discussed below.

As shown in FIG. 24, in case of the conventional system, dendrite arm spacing (DAS) in the region of the combustion chamber was 45 to 53 μm and, in case of the present invention, the DAS in the region of the combustion chamber was below 40 μm.

According to preferred embodiments of the present invention, it is possible to improve the DAS and porosity due to the microstructure of the lower surface of the cylinder head. Moreover, in preferred embodiments, it is possible to suitably improve the dimensional stability and prevent the material from being torn away since the mold transformation may be be required. In other further embodiments, it is possible to suitably improve productivity by approximately 30%, to reduce operation cost for the molten-metal holding furnace, and to save energy by suitably reducing cycle time by about 200 seconds compared with the conventional system.

Definitions of the terms used in the present invention will be described below.

(1) Dendrite arm spacing (DAS): DAS represents the spacing between dendrite arms suitably grown during solidification of molten metal and preferably includes a primary dendrite arm growing in the solidification direction of the molten metal and a secondary dendrite arm growing in the vertical direction to the first direction. According to preferred embodiments, the smaller the DAS is, the more the mechanical properties such as elongation, fatigue strength, etc. are improved. According to other preferred embodiments, the DAS is determined by the casting temperature and cooling rate between 570 to 618° C.

(2) Porosity: Porosity is a measure of the percentage of pores on the surface of a section of 5 mm square. In certain embodiments, if the porosity is high, the strength is reduced. The pores include shrinkage pores produced when the molten metal is solidified from liquid phase to solid phase as the volume of pores is reduced and gas pores produced when the solubility of hydrogen gas contained in Al molten metal is reduced as the molten metal is cooled. According to preferred embodiments of the invention, in case of the gas pores, as the cooling process proceeds, the solubility of H is suitably reduced, and thus supersaturated H forms $H_2$. Because hydrogen gas moves to the liquid phase, in certain embodiments, pores are produced around the sprue (final solidification portion).

As described above, the cooling system for a low-pressure casting mold in accordance with the present invention provides the following effects.

(1) With the use of the electric heater for heating the connection pipe, it is possible to automatically control the temperature and, in preferred embodiments since it does not affect the temperature of the mold, it is advantageous to cool the mold.

(2) Since the sprue is preferably located on the side surface of the cylinder head to ensure a sufficient distance between the combustion chamber and the sprue, it is possible to preferably install the cooling system combined with water cooling and air cooling in the lower mold, thus suitably reducing the solidification time and the cycle time of the overall process.

(3) With the air cooling type cooling system preferably provided at the side mold, it is possible to suitably cool the gas during the gas discharge.

(4) With the cooling system preferably combined with water cooling and air cooling provided at the upper mold, it is possible to considerably increase the cooling rate of the mold.

(5) It is possible to improve the mechanical properties of the material used by reducing the cooling rate of the lower mold, and preferably, the cooling rate of the combustion to reduce the DAS and porosity.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A cooling system for a low-pressure casting mold including an upper mold, a side mold having a cavity in the middle thereof, and a lower mold such that molten metal is filled and solidified in the cavity to mold a cylinder head, the cooling system comprising:

a sprue formed on a portion of the low-pressure casting mold corresponding to a mold cavity;

a first cooling means for cooling the mold by supplying a cooling fluid to the upper mold;

a second cooling means for cooling the mold by supplying a cooling fluid to a side mold; and a third cooling means for cooling the mold by supplying a cooling fluid to a lower mold, wherein the first cooling means includes:

a housing including a cooling water inlet and a cooling water outlet formed on one side surface thereof, in which a lower portion is attached to an upper surface of the upper mold;

a plurality of spark plug pins connected to the cooling water inlet and the cooling water outlet and provided parallel to the vertically downward direction in the inside of the housing; and a cooling line introduced in the horizontal direction and discharged in the opposite direction with the spark plug pins interposed therebetween, wherein cooling water introduced through an inlet of each of the spark plug pins cools the upper mold and is then discharged through the cooling water outlet.

2. The cooling system of claim 1, wherein the second cooling means comprises:

a gas inlet and a gas outlet formed in the side mold to discharge gas from the mold;

a cooling portion formed between the gas inlet and the gas outlet and receiving a cooling fluid from the outside;

a gas suction portion divided by the cooling portion and a partition and connected to the gas inlet so as to suck gas introduced through the gas inlet;

a cooling fluid supply path connected to the cooling portion to supply the cooling fluid; and a cooling fluid discharge pipe penetrating from the cooling portion to the gas suction portion and extending to an outlet to discharge the cooling fluid, wherein exhaust gas in the mold is introduced to the gas suction portion through the gas inlet, cooled by the cooling fluid discharge pipe, and then discharged through a gap between the outlet and the cooling fluid discharge pipe.

3. The cooling system of claim 2, wherein the third cooling means comprises:

a cooling fluid supply pipe and a cooling fluid discharge pipe provided parallel to the vertical direction from the outside to the inside of the lower mold;

a three-way valve, provided at an inlet portion of the cooling fluid supply pipe and including a water injection hole formed on an upper portion thereof in the upward direction and a cooling air injection hole formed on a side surface thereof in the horizontal direction; and a discharge pipe connecting the cooling fluid discharge pipe in the horizontal direction, wherein cooling water supplied through the water injection hole and cooling air supplied through the cooling air injection hole move to the cooling fluid supply pipe to cool the lower mold and are then discharged through the cooling fluid discharge pipe and the discharge pipe.

4. The cooling system of claim 3, further comprising:

a housing including a cooling water inlet pipe and a cooling water outlet pipe formed on one side surface thereof and attached to an upper surface of the upper mold; and a plug pin for cooling the inside of the lower mold protruding in the upward direction from the housing, wherein the cooling water is introduced through the cooling water inlet pipe to cool the lower mold and is then discharged through the cooling water discharge pipe.

5. The cooling system of claim 2 wherein the cooling fluid is cooling water or cooling air.

6. The cooling system of claim 1, wherein the cooling fluid is cooling water or cooling air.

7. The cooling system of claim 1, further comprising:

a connection pipe connected to the lower mold and including a sprue formed therein, and an electric heater in which a coil is inserted as a heating element and surrounding the outer circumference of the connection pipe.

* * * * *